US008136750B2

(12) United States Patent
Ueno

(10) Patent No.: US 8,136,750 B2
(45) Date of Patent: Mar. 20, 2012

(54) POWDER PROCESSING APPARATUS AND POWDER PROCESSING SYSTEM

(75) Inventor: Akinori Ueno, Yachiyo (JP)

(73) Assignee: Earthtechnica Co., Ltd., Tokyo (JP)

( * ) Notice: Subject to any disclaimer, the term of this patent is extended or adjusted under 35 U.S.C. 154(b) by 0 days.

(21) Appl. No.: 12/787,106

(22) Filed: May 25, 2010

(65) Prior Publication Data

US 2010/0230524 A1 Sep. 16, 2010

Related U.S. Application Data

(62) Division of application No. 11/516,656, filed on Sep. 7, 2006, now abandoned.

(30) Foreign Application Priority Data

Oct. 13, 2005 (JP) ..... 2005-298349
May 31, 2006 (JP) ..... 2006-152847

(51) Int. Cl.
*B02C 19/00* (2006.01)

(52) U.S. Cl. ..... 241/257.1; 241/260; 241/293

(58) Field of Classification Search ..... 241/357.1, 241/260, 293

See application file for complete search history.

(56) References Cited

U.S. PATENT DOCUMENTS

| | | | |
|---|---|---|---|
| 76,270 | A | 3/1868 | Taggart |
| 3,221,999 | A | 12/1965 | Cumpston, Jr. |
| 3,305,180 | A | 2/1967 | Tomlinson |
| 3,305,183 | A | 2/1967 | Morden |
| 3,745,645 | A | 7/1973 | Kurth et al. |
| 3,806,050 | A | 4/1974 | Cumpston, Jr. |
| 4,562,972 | A | 1/1986 | Hagiwara et al. |
| 5,845,855 | A | 12/1998 | Yamada et al. |

FOREIGN PATENT DOCUMENTS

| | | |
|---|---|---|
| JP | 5-32094 | 5/1993 |
| JP | 5-32095 | 5/1993 |
| JP | 09-201543 A | 8/1997 |

*Primary Examiner* — Faye Francis

(74) *Attorney, Agent, or Firm* — Oblon, Spivak, McClelland, Maier & Neustadt, L.L.P.

(57) ABSTRACT

A powder processing apparatus includes a main body portion having a cylindrical rotor rotating at a high speed, and a cylindrical stator arranged coaxially with the rotor, outside the rotor with a gap therebetween; a supply port provided at one end of the main body portion, and supplying a processing raw material into the gap together with an airflow; and a discharge port provided at the other end of the main body portion, and discharging, from the gap, a processed product obtained by spheroidizing the processing raw material between the rotor and the stator. In the inner peripheral surface of the stator, there are provided circumferential grooves orthogonally intersecting the axis line of the stator, or a spiral groove forming an angle of not less than 60 degrees and less than 90 degrees with respect to the axis line.

17 Claims, 9 Drawing Sheets

POWDER PROCESSING APPARATUS AND POWDER PROCESSING SYSTEM

The present application is a Divisional Application of U.S. patent application Ser. No. 11/516,656, filed on Sep. 7, 2006, and now abandoned.

BACKGROUND OF THE INVENTION

1. Field of the Invention

The present invention relates to a powder processing apparatus and powder processing system. More specifically, the present invention concerns a powder processing apparatus and powder processing system that perform spheroidization processing for improving the degree of sphericity and surface smoothness of scale-shaped powder, indefinite (polygonal) shaped powder or powder with surface irregularities, and easily pulverizable powder, and that perform compounding processing by causing the surface of powder (base powder) to be adhered by other powder (additional powder).

2. Description of the Related Art

In recent years, regarding powder used as materials for electronic techniques, materials for optical techniques, polymer materials, and medical materials, demand has grown for the improvement in the fluidity and filling property of powder by the improvement in particle shape of powder, especially by the spheroidization of its irregular-shaped particles. Furthermore, demand has also grown for the improvement in physical properties of powder, especially for the alteration of powder surfaces and the enhancement of functionality by the compounding of at least two kinds of powders. Powder processing apparatuses and powder processing systems used for such powder spheroidization processing and further compounding processing (hereinafter, these processing may be simply referred to as processing such as spheroidization) are disclosed in Japanese Examined Patent Application Publication Nos. 5-32094 and 5-32095. These apparatuses and systems are configured to include a main body portion having a cylindrical rotor and a stator arranged outside the rotor with a minute gap therebetween; a supply port provided at one end of the main body portion, and supplying powder together with an airflow along a tangential direction of the rotor; and a discharge port provided at the other end of the main body portion, and discharging powder that has been subjected to spheroidization or the like, together with the airflow along the tangential direction of the rotor.

In these powder processing apparatuses, on the outer surface of the rotor and the inner surface of the stator, a large number of protrusion members parallel to generating lines are continuously provided along a circumferential direction. Under the rotation of the rotor, a large number of minute vortexes are formed in gaps formed between individual protrusion members, and powder with irregular particle shapes, dispersed in the airflow, or at least two kinds of powders make strong contact with one another. As a result, in these apparatuses, powder is continuously subjected to processing such as spheroidization.

Furthermore, as powder processing systems, these patent documents set forth systems including, on the upstream of the powder processing apparatus, airflow generating means for generating an airflow for supplying powder to the apparatus, heat exchange means for heating and/or cooling the airflow; a raw material feeder (including a raw material mixer) for dispersing powder into the temperature-adjusted airflow, and further including, on the downstream side of the powder processing apparatus, a collector for separating from the airflow and collecting powder that has been subjected to processing such as spheroidization by the powder processing apparatus, and a blower for moving the airflow in the powder processing system.

However, in the powder processing apparatus set forth in the Japanese Examined Patent Application Publication No. 5-32094, in performing a spheroidization processing, powder that is susceptible to plastic deformation at a temperature on the level of 60° C. or less, i.e., low-melting powder could be subjected to a spheroidization processing, but powder requiring 100° C. or more for its plastic deformation, i.e., high-melting powder, and powder that is not subject to plastic deformation such as graphite could not be subjected to a spheroidization processing. With such being the situation, as a method for making the spheroidization processing implementable, increasing the revolution number of the rotor of the powder processing apparatus was thought of. However, the increase of revolution number caused strong vortexes in the gaps formed between protrusion members. This raised a problem in that powder becomes easily pulverizable and that it tends to decrease in its particle diameter, rather than it is rendered spherical.

Also in the Japanese Examined Patent Application Publication No. 5-32095, in compounding processing, when powder susceptible to pulverization was to be processed, it was necessary to prevent the powder from being pulverized by widening the gap formed between the rotor and stator, or by using an operating condition with a revolution number reduced. However, the reduction of revolution number weakened vortexes formed between the gap, thereby causing a problem of reducing the compounding effect itself. This limits the usable revolution number range and narrows the adjustment range of the compounding effect itself. Also, in order to adjust the gap, it is necessary to change the inner diameter of the stator or the outer diameter of the rotor, that is, this gap adjustment involves component replacements. This makes it difficult to freely adjust operating conditions.

It has been found that, when grooves in the axis direction of the stator in the conventional powder processing apparatus are eliminated to make a cylinder smooth, the powder can be subjected to processing such as spheroidization without being pulverized even if the revolution number of the rotor is increased. However, by this method, the progress of the processing such as spheroidization is so slow that a single pass of the powder through the apparatus does not allow the powder to be sufficiently subjected to the proceeding such as spheroidization, thus necessitating to pass the powder through the apparatus multiple times. This unfavorably makes it difficult to perform mass processing of powder. It has been further found that, in the conventional powder processing apparatus, a reduction of air volume (flow rate) to nearly one third the usual air volume allows the proceeding such as spheroidization to be promoted. However, the reduction of the air volume makes a flow of powder unstable, as well as promotes the increase in processing temperature. As a result, in powder susceptible to temperature (i.e., low-melting powder), fusion between powder particles occurs, which undesirably makes the proceeding such as spheroidization infeasible. Therefore, in order to carry out processing of powder by a single processing such as spheroidization, it is necessary to prolong the time (stay time) during which powder passes through the apparatus without reducing the air volume. In the conventional apparatuses, it might be better if the overall length of the stator and rotor are increased, but the stator and rotor have length limitations imposed by problems associated with mechanical strength, installation space, production costs or the like, resulting from the weight increase of the apparatus.

SUMMARY OF THE INVENTION

Accordingly, it is an object of the present invention to provide a powder processing apparatus and powder processing system capable of subjecting a large amount of powder to spheroidization processing by a single pass, and further to compounding processing without the powder being pulverized, as well as capable of subjecting powder from powder that is not subject to plastic deformation, such as graphite, down to low-melting powder, to the spheroidization processing, and further compounding processing irrespective of a powder characteristic.

A powder processing apparatus according to a first aspect of the present invention has a main body portion including a cylindrical rotor that rotates at a high speed; and a cylindrical stator arranged coaxially to a rotational axis of the rotor, outside the rotor with a gap therebetween. Furthermore, the powder processing apparatus comprises a supply port that is provided at one end of the main body portion, and that supplies a processing raw material into the gap together with an airflow; and a discharge port that is provided at the other end of the main body portion, and that discharges, from the gap, a processed product obtained by spheroidizing the processing raw material between the rotor and the stator. Besides, in the inner peripheral surface of the stator, there are provided circumferential grooves that orthogonally intersect the axis line of the stator, or a spiral groove that forms an angle of not less than 60 degrees and less than 90 degrees with respect to the axis line.

In this case, the processing raw material that has been supplied from the supply port into the gap together with the airflow, passes through the gap from the supply port toward the discharge port while being pressed by the stator under swirling flows caused by the rotation of the rotor. Here, because the circumferential grooves or a spiral groove is provided in the inner peripheral surface of the stator, the processing raw material is pressed against the groove bottoms by a centrifuged force under swirling flows. Since the processing raw material must move in the direction opposite to that of centrifuged force in order to get out of the grooves, it cannot easily get out of the grooves, and stays for a long time in the grooves. This eliminates the need for the reduction in air flow (flow rate of air) for the purpose of elongating the stay time. As a result, contact between the wall surfaces and processing raw material, and contact between particles of the processing raw material increase, thereby promoting the spheroidization processing of the processing raw material. As a consequence, the throughput of the apparatus is improved, as well as heat generated by the spheroidization processing can be cooled by the airflow, thereby suppressing the rise of processing temperature.

Also, unlike gaps formed by the protrusion members parallel to the axis line, provided in the conventional powder processing apparatus, the gap formed between the rotor and stator in the present powder processing apparatus can reduce the occurrence of strong vortexes, thereby preventing the processing raw material from pulverization. Furthermore, the processed product having been subjected to spheroidization processing between the rotor and stator is discharged from the gap together with the airflow.

A powder processing apparatus according to a second aspect of the present invention has a main body portion including: a cylindrical rotor that rotates at a high speed; and a cylindrical stator arranged coaxially to a rotational axis of the rotor, outside the rotor with a gap therebetween. Furthermore, the powder processing apparatus comprises a supply port that is provided at one end of the main body portion, and that supplies a processing raw material into the gap together with an airflow; and a discharge port that is provided at the other end of the main body portion, and that discharges, from the gap, a processed product obtained by spheroidizing the processing raw material between the rotor and the stator. The inner peripheral surface of the stator comprises: a first groove formation region in which circumferential grooves orthogonally intersecting the axis line of the stator, or a spiral groove forming an angle of not less than 60 degrees and less than 90 degrees with respect to the axis line are formed; and a second groove formation region which is formed contiguously with the first groove formation region, and in which vertical grooves parallel to the axis line, or oblique vertical grooves forming an angle of more than 0 degree and not more than 45 degrees with respect to the axis line are formed.

In this case, as in the case of the powder processing apparatus according to the first aspect of the present invention, swirling flows occur under the rotation of the rotor, in the first groove formation region (gap) provided in the inner peripheral surface of the stator, whereby the occurrence of vortex flows is suppressed. Also, under the centrifuge force by the swirling flows, the processing raw material that has been supplied from the supply port into the gap together with an airflow stays in the circumferential grooves or spiral groove for a long time, so that there is no need to reduce the air volume. This allows spheroidization processing to be performed without increasing the processing temperature, and while suppressing the pulverization of the processing raw material. Thereby, the spheroidization processing of the processing raw material is promoted, and the throughput of the apparatus is improved. Here, the processed product having been subjected to the spheroidization processing is discharged from the discharge port together with the airflow.

Moreover, by providing the stator with the second groove formation region in which vertical grooves or oblique vertical grooves, powder is dispersed. For example, when the second groove formation region is provided on the supply port side of the stator, the processing raw material supplied into the gap is dispersed; when this region is provided in the intermediate portion, the processing raw material that has been coagulated in the gap, or the processed product having been subjected to spheroidization processing is dispersed; and when this region is provided on the supply port side of the discharge port, the processed product that has been coagulated is dispersed. As a consequence, the spheroidization processing of processing raw material is promoted.

Furthermore, the present invention provides a powder processing system including one of the above-described powder processing apparatuses, and devices described below. That is, this powder processing system is a system configured to includes: an exhaust device arranged downstream of the powder processing apparatus, the exhaust device generating an airflow that is supplied into the supply port and that is discharged from the discharge port; a raw material supply device that is arranged upstream of the powder processing apparatus, and supplies a processing raw material to the airflow formed upstream of the powder processing apparatus, in order to supply the processing raw material into the supply port together with the airflow formed upstream of the powder processing apparatus; a recovery device that is arranged upstream of the exhaust device, and that recovers a processed product that has been spheroidized by the powder processing apparatus from the airflow discharged from the discharged port; and a cooler that is arranged upstream of the powder processing apparatus, and that cools the airflow to be supplied into the supply port.

In this case, by providing the raw material supply device, the supply amount of the processing raw material into the supply port is adjusted. Also, by providing the exhaust device, adjustments are performed with respect to the flow rate of an airflow supplied into the supply port together with the processing raw material, the flow rate (air volume) of an airflow passing through the gap of the powder processing apparatus, and the flow rate of an airflow discharged from the discharge port together with the processed product that has been spheroidized. Furthermore, by providing the recovery device, the processed product that has been spheroidized is efficiently recovered. Moreover, by providing the cooler, the temperature of processing raw material supplied into the powder processing apparatus is reduced, thereby decreasing the processing temperature during the spheroidization processing. This allows the prevention of fusion between particles of the processing raw material. As a result, the spheroidization processing of processing raw material is promoted, leading to an enhancement of the throughput of the apparatus. This is especially prominent in low-melting processing raw materials.

Also, the present invention provides another powder processing system including one of the above-described powder processing apparatuses, the powder processing system further including: a raw material supply device that is arranged upstream of the powder processing apparatus, and that supplies a processing raw material into the supply port together with the airflow; an exhaust device arranged downstream of the powder processing apparatus, the exhaust device generating an airflow that is supplied into the supply port and that is discharged from the discharge port; a recovery device that is arranged upstream of the exhaust device, and that recovers a processed product that has been spheroidized by the powder processing apparatus, from the airflow discharged from the discharged port; and a heater that is arranged upstream of the powder processing apparatus, and that heats the airflow to be supplied into the supply port.

According to this construction, as in the case of the above-described powder processing apparatus, the supply amount of processing raw material and the flow rate of an airflow passing through the powder processing system are adjusted, as well as the processed product that has been spheroidized is efficiently recovered. Also, by providing the heater, the temperature of the processing raw material to be supplied into the powder processing apparatus is increased, thereby increasing the processing temperature during the spheroidization processing. This makes it possible to subject the processing raw material to the spheroidization processing while softening it. As a result, the spheroidization processing of processing raw material is promoted, and the throughput of the apparatus is increased. This is especially prominent in high-melting processing raw materials. Here, even if the airflow to be supplied into the supply port is heated, there is no possibility that the temperature during the spheroidization processing will increase up to the temperature at which fusion between particles of the processing raw material occurs.

It is preferable that a powder processing system further having a raw material mixer for mixing at least two kinds of processing raw material, be formed downstream of the raw material supply device.

In this case, at least two kinds of processing raw material are mixed by the raw material mixer, thereby producing a mixed processing raw material obtained by adhering a processing raw material serving as the additive powder (powder with a smaller particle-diameter) on the surface of the base powder (powder with a larger particle-diameter). By this mixed processing raw material being supplied into the powder processing apparatus (gap), the processing raw material is compounded over the entire region of the gap from the supply port side to the discharge side, unlike the powder processing system in which the adhesion of the processing raw material advances in the gaps on the supply port side. This prolongs the processing time for compounding, thereby achieving a stronger compounding state.

It is preferable that a powder processing system be formed in which a processing raw material that is made up by previously mixing at least two kinds of processing raw materials, is used as the processing raw material; one material supply device that supplies the processing raw material that has been obtained by the previous mixture is arranged upstream of the powder processing apparatus; and a processed product that has been compounded by the powder processing apparatus are recovered by the recovery device.

In this case, a processing raw material made up by mixing at least two kinds of processing raw materials in advance, is supplied into the gap of the powder processing apparatus together with the temperature-adjusted airflow, by the one raw material supply device, and thereby the processing raw material is compounded over the entire region of the gap from the supply port side to the discharge side. This prolongs the processing time for compounding, thereby achieving a stronger compounding state.

Furthermore, the present invention provides a further powder processing system including one of the above-described powder processing apparatuses, the powder processing system further including: an exhaust device arranged downstream of the powder processing apparatus, the exhaust device generating an airflow that is supplied into the supply port and that is discharged from the discharge port; one raw material supply devices that is arranged upstream of the powder processing apparatus, and that supplies at least two kinds of processing raw materials mixed in advance to the airflow formed upstream of the powder processing apparatus, in order to supply the at least two kinds of processing raw materials into the supply port together with the airflow formed upstream of the powder processing apparatus; and a recovery device that is arranged upstream of the exhaust device, and that recovers a processed product compounded by the powder processing apparatus, from the airflow that has been discharged from the discharged port.

In this case, at lease two kinds of processing raw materials that are mixed in advance, is supplied into the gap of the powder processing apparatus together with the airflow, by the one raw material supply device, and thereby the processing raw material is compounded over the entire region of the gap from the supply port side to the discharge side. This prolongs the processing time for compounding, thereby achieving a stronger compounding state.

DESCRIPTION OF THE PREFERRED EMBODIMENTS

Hereinafter, embodiments of a powder processing apparatus and powder processing system according to the present invention will be described with reference to the accompanying drawings.

In the present invention, the term "powder" refers to powder having an average particle diameter of not more than several hundred μm, typified by toner, graphite, nylon, titanium oxide etc., whatever it may be organic or inorganic. The term "powder processing" refers to (1) subjecting powder with irregular particle shapes (e.g., powder with an average particle diameter of 5 to 50 μm) to spheroidization processing, or (2) subjecting powder to compounding processing by causing surface of powder (base powder) to be adhered by other powder (additional powder; preferably, powder with an average particle diameter of not more than one tenth part, and more preferably, one hundredth part of the average particle diameter of the base powder), that is, subjecting at least two kinds of powders having functions different from each other to compounding processing. In the compounding processing, spheroidization processing with respect to the compounded powder is also concurrently performed.

Figure 1A:
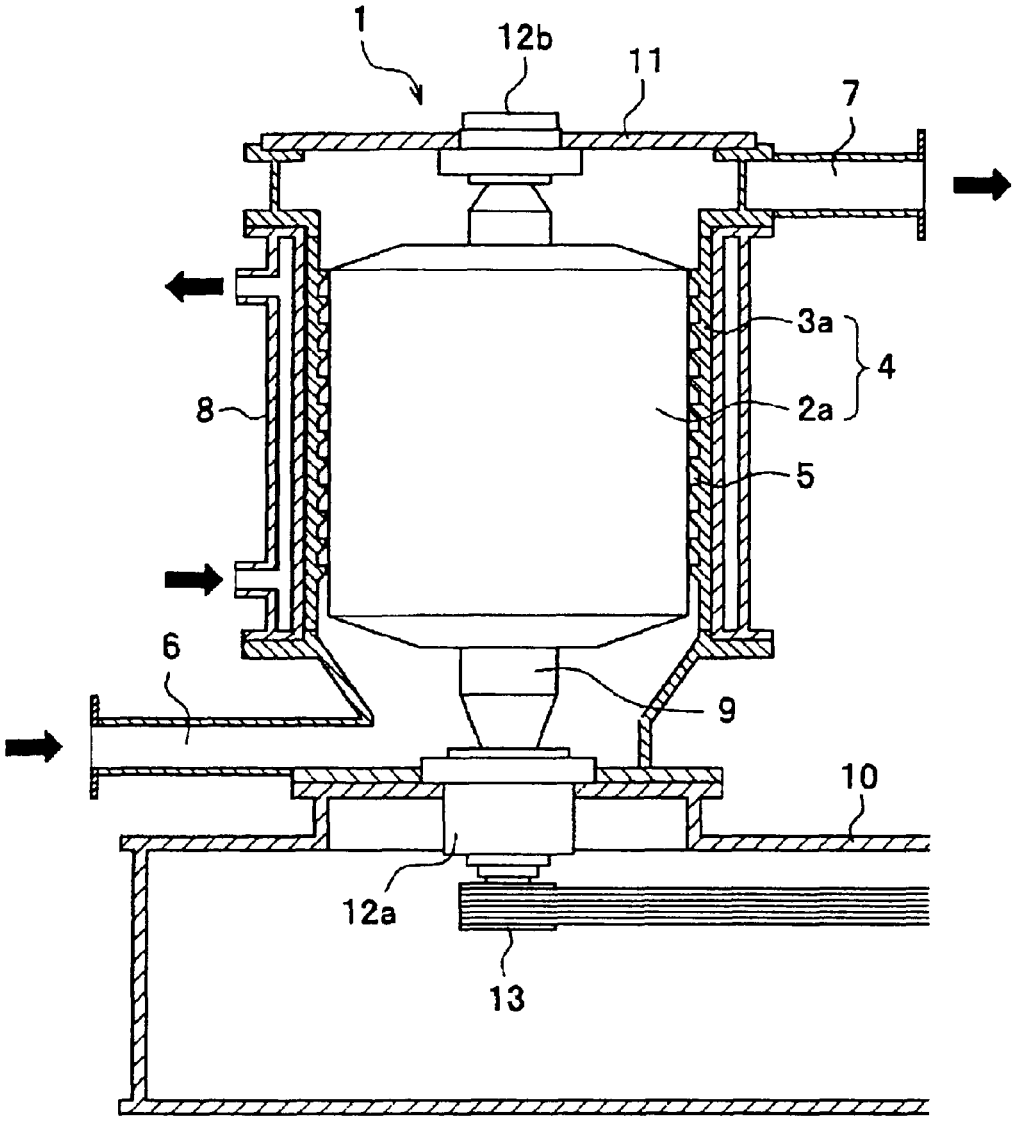
FIG. 1A is a sectional view showing the construction of a powder processing apparatus according to the present invention.
Figure 1B:
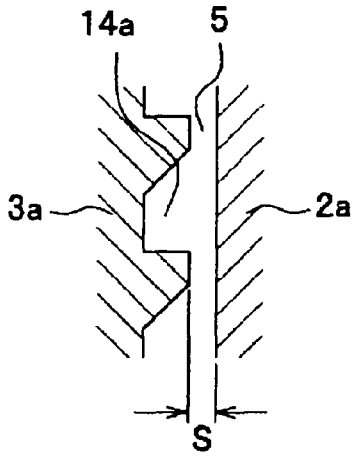
FIG. 1B is an enlarged sectional view showing sectional shapes of a rotor and a first stator in FIG. 1A.
Figure 3A:
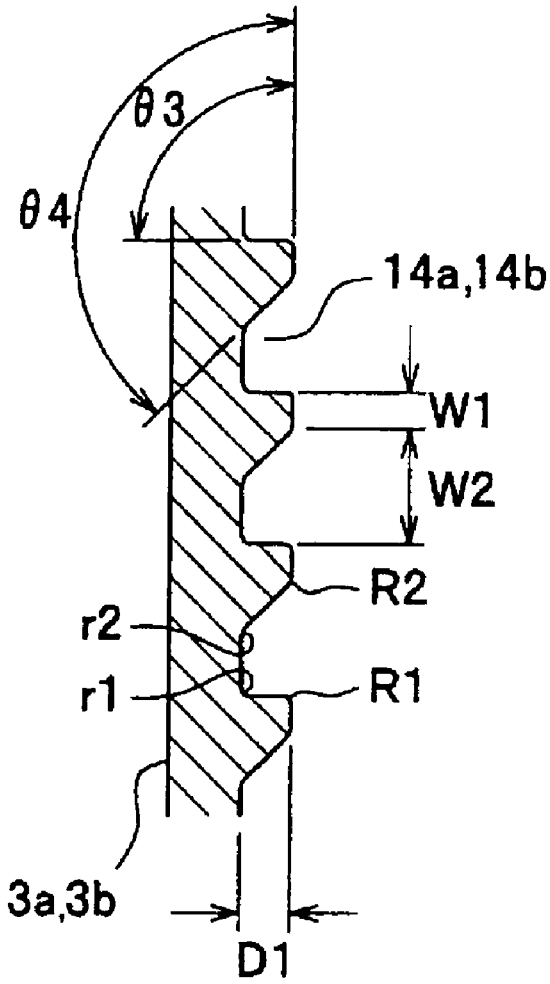
FIGS. 3A and 3B are each an enlarged sectional view showing a sectional shape of circumferential grooves or a spiral groove formed in the stator.
Figure 3B:
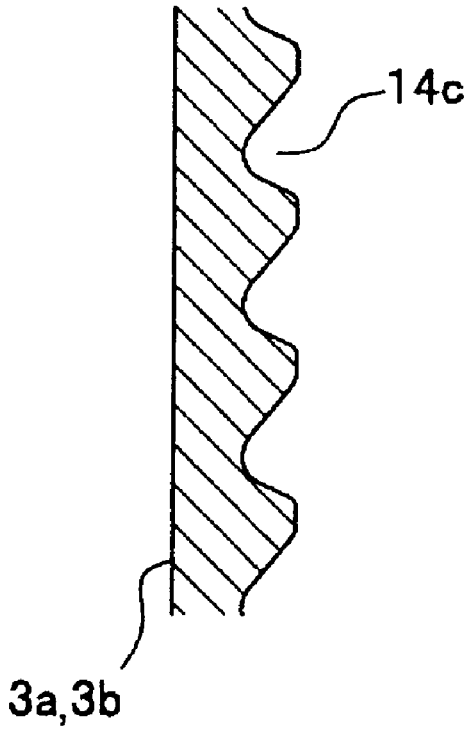
Figure 4A:
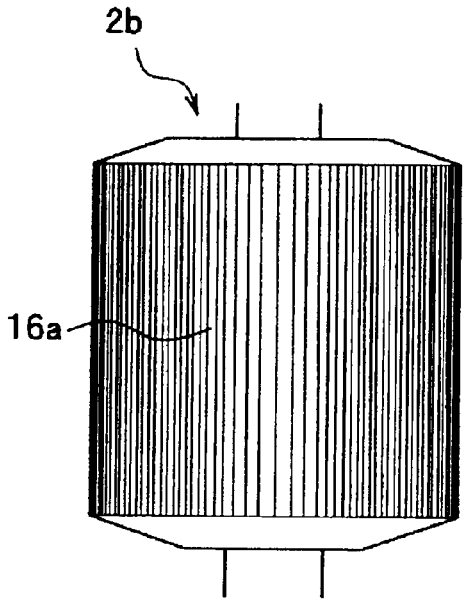
FIG. 4A to 4C are front views showing the outer peripheral surface of other rotors.
Figure 4B:
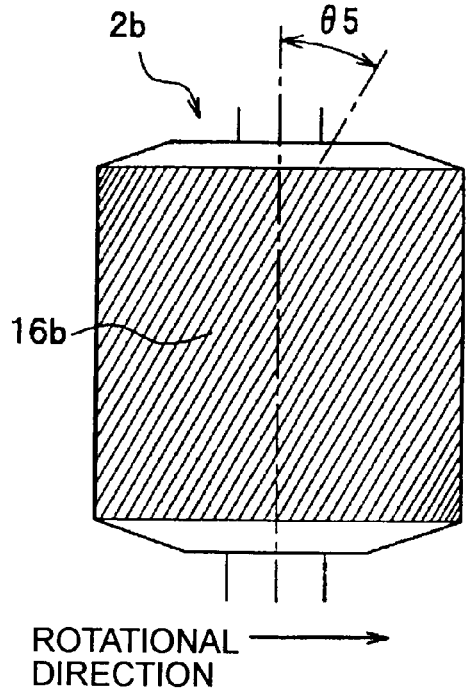
Figure 4C:
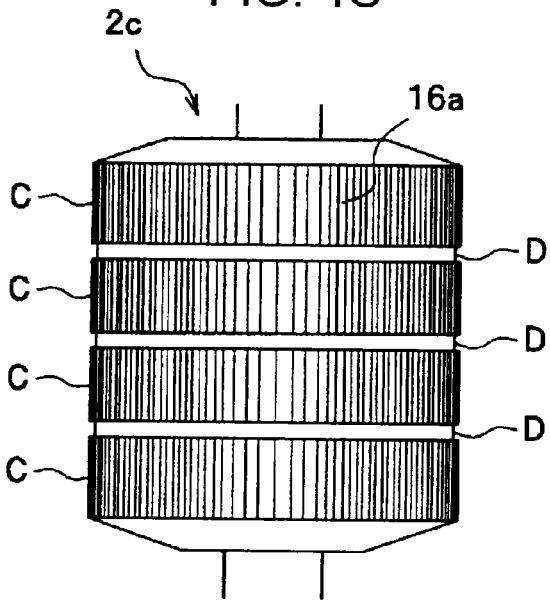
Figure 4D:
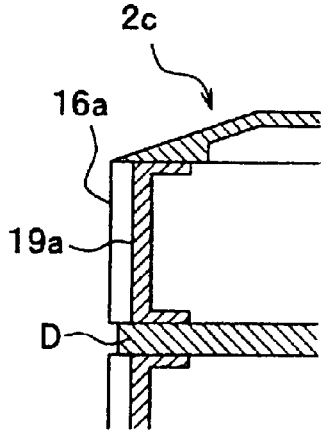
FIG. 4D is an enlarged sectional view showing a main portion of FIG. 4C.
Figure 5A:
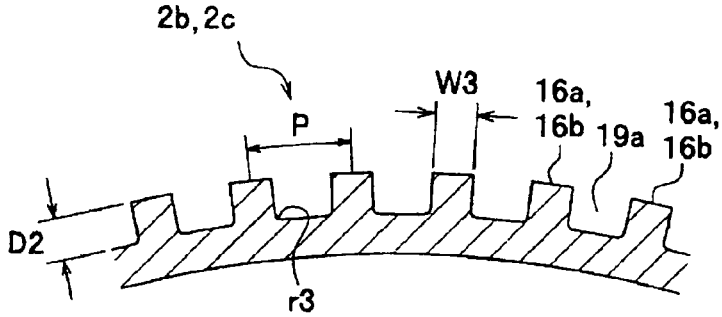
FIGS. 5A and 5B, respectively, are an enlarged sectional view showing sectional shapes of vertical convex portions and oblique convex portions formed on the rotor.
Figure 5B:
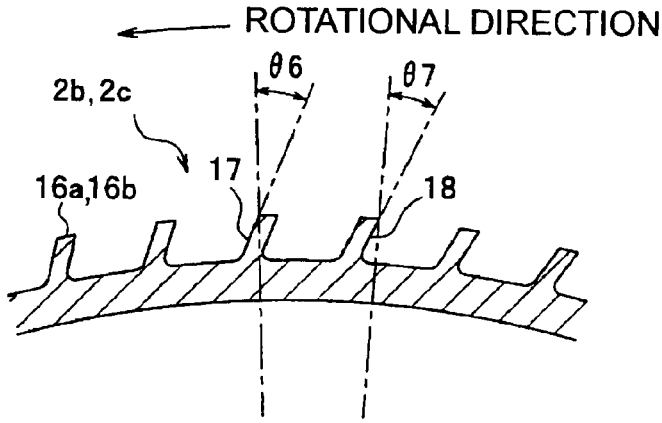
Figure 6A:
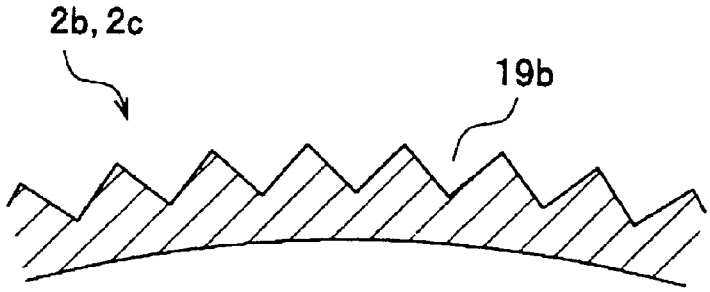
FIG. 6A to 6C are enlarged sectional views showing sectional shapes of other vertical convex portions and oblique convex portions.
Figure 6B:
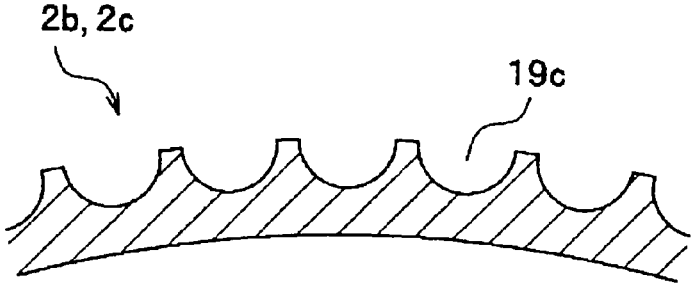
Figure 6C:
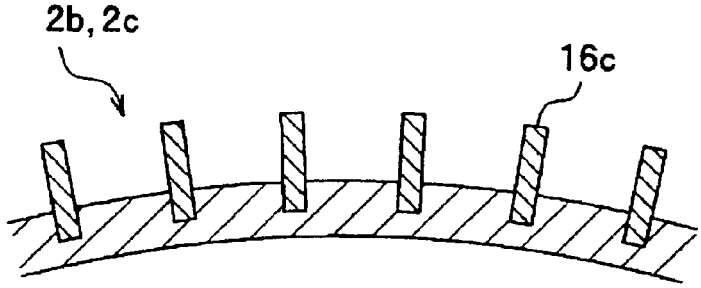

FIG. 1A is a sectional view showing the construction of a powder processing apparatus according to the present invention, and FIG. 1B is an enlarged sectional view showing a the sectional shapes of a rotor and a first stator in FIG. 1A; FIGS. 2A to 2D are sectional views showing inner peripheral surfaces of the first stator and a second stator; FIGS. 3A and 3B are each an enlarged sectional view showing a sectional shape of circumferential grooves or a spiral groove formed in the stator; FIG. 4A to 4C are front views showing the outer peripheral surface of other rotors, and FIG. 4D is an enlarged sectional view showing a main portion of FIG. 4C; FIGS. 5A and 5B, respectively, are an enlarged sectional view showing sectional shapes of vertical convex portions and oblique convex portions formed on the rotor; FIGS. 6A to 6C are enlarged sectional views showing sectional shapes of other vertical convex portions and oblique convex portions; and FIGS. 7 to 12 are each a schematic diagram showing the construction of powder processing system according to the present invention.

In the embodiments of powder processing apparatus and powder processing system according to the present invention, explanation is made with reference to drawings in which the axis line of the rotor and stator in the main body portion is configured to be perpendicular to the ground, but the present invention is not limited to these illustrations. That is, the axis line of the rotor and stator in the present invention may be configured to form an angle other than a right angle with respect to the ground. For example, the axis line may be provided in parallel with the ground.

[Powder Processing Apparatus]

In the present invention, for either of the spheroidization processing and compounding processing, a powder processing apparatus of the same construction is used.

First, a first embodiment of powder processing apparatus will be described.

As shown in FIG. 1A, regarding the powder processing apparatus according to the first embodiment, the powder processing apparatus 1 comprises a main body portion 4 including a rotor 2*a* and stator 3*a*, a supply port 6 provided at an end of the main body 4, and a discharge port 7 provided at the other end of the main body 4. An explanation of each construction will be given below.

(Main Body Portion)

The main body portion 4 includes a rotor 2*a* and a stator 3*a* arranged coaxially to the rotor 2*a*, outside the rotor 2*a* with a gap 5 therebetween. As shown in FIG. 1B, the gap 5 constitutes a distance S between the outermost peripheral surface of the rotor 2*a*, and the innermost peripheral surface of the stator 3*a*, i.e., the peak surface of mountain portions formed between circumferential grooves 14*a* formed in the stator 3*a*, and this distance S is preferably 0.5 to 5 mm. As will be described later, when vertical convex portion 16*a* of oblique convex portion 16*b* (refer to FIGS. 4A and 4B, and FIG. 5A) is formed on the outer peripheral surface of the rotor, the outermost peripheral surface of the rotor constitutes the peak surface of each convex portion. Also, as described later, when spiral groove 14*b*, vertical grooves 15*a*, or oblique vertical grooves 15*b* (refer to FIGS. 2B to 2D) are formed in the inner peripheral surface of the stator, the innermost peripheral surface of the stator constitutes the peak surface of mountain portions formed between groove portions or grooves. When the distance S is less than 0.5 mm, contact between particles of the processing raw material in the gap 5, and contact between the processing raw material and the outermost peripheral surface of the rotor 2*a*, or the innermost peripheral surface of the stator 3*a* becomes remarkable, so that the outermost peripheral surface or innermost peripheral surface becomes apt to suffer a seizure phenomenon. On the other hand, when the distance S is more than 5 mm, swirling flows becomes less prone to occur in the gap 5, so that the spheroidization processing and compounding processing each become difficult to advance.

(First Rotor)

The rotor 2*a* has a rotating shaft 9. The rotating shaft 9 is vertically arranged on a base 10 by being supported by a bearing 12*b* provided in a top plate 11 and a bearing 12*a* provided in the base 10. At the lower end of the rotating shaft 9, there is provided a V-belt pulley 13 to be driven by a drive unit (not shown). The rotor 2*a* rotates at a high speed, i.e., a normal peripheral speed of 100 to 130 m/s, and maximum peripheral speed of 170 m/s about the rotating shaft 9 under driving by the drive unit. The rotor 2*a* is a cylinder body made of metal or the like, and its outer peripheral surface have preferably been subjected to anti-wear processing by hard chrome plating or thermal spraying with cemented carbide or the like.

(First Stator)

As described above, the stator 3*a* is arranged coaxially to the rotor 2*a*, outside the rotor 2*a* with a gap 5 therebetween. The stator 3*a* is a cylinder body made of a metal or the like, and its inner peripheral surface is preferably subjected to anti-wear processing by hard chrome plating or thermal spray with cemented carbide or the like. The stator 3*a* may either be of a liner type, or of an integral type. Also, the stator 3*a* preferably has a cooling jacket 8.

Figure 2A:
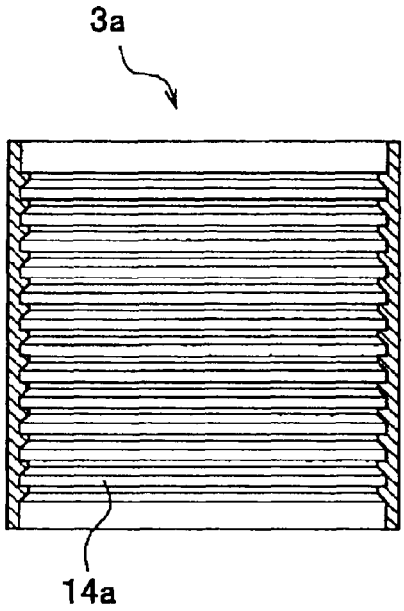
FIGS. 2A to 2D are sectional views showing inner peripheral surfaces of the first stator and a second stator.
Figure 2B:
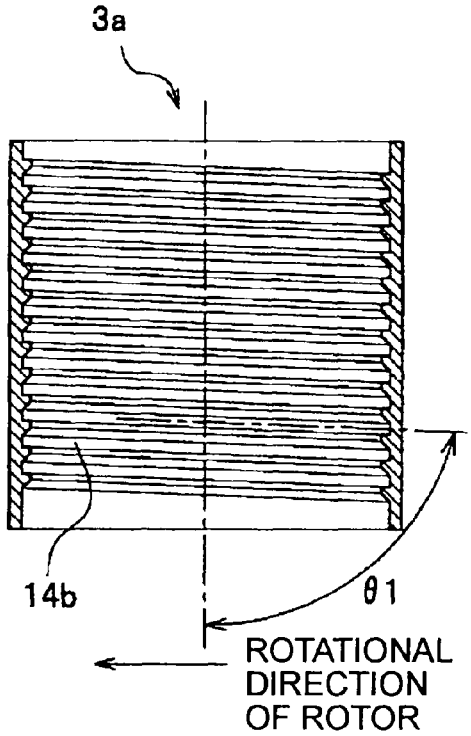

As shown in FIG. 2A, in the stator 3*a*, circumferential grooves 14*a* orthogonally intersecting the axis line of the stator 3*a* are formed in a multistage manner in its inner peripheral surface. As shown in FIG. 2B, the stator 3*a* may also be one configured so that a spiral groove 14*b* forming an angle θ1 of not less than 60 degrees and less than 90 degrees with respect to the axis line. Also, the spiral groove 14*b* may consist of multiple-threaded grooves, although not shown.

When the angle θ1 of the spiral groove 14*b* is 90 degrees, this spiral groove 14*b* is equivalent to the circumferential groove 14*a*. When the θ1 is less than 60 degrees, there occurs no swirling flow in the grooves. As a result, the stay time in the gap, of the processing raw material cannot be made long, so that neither spheroidization processing nor compounding processing advances. Here, the spiral direction of the spiral groove 14*b* from the lower end toward the upper end of the stator 3*a* may either be the same direction as the rotational direction of the rotor 2*a*, or a different direction therefrom. However, the spiral direction of the spiral groove 14*b* is preferably the same direction as the rotational direction of the rotor 2*a* because swirling flows more easily occur in the grooves under this condition.

The shape of the circumferential grooves 14*a* or spiral groove 14*b* is preferably rectangle (trapezoid) as shown in FIG. 3A, triangle (refer to groove 14*c*) as shown in FIG. 3B, or U-shape (not shown). The size of the groove configuration is preferably as follows: groove width W2=5 to 50 mm; groove depth D1=3 to 20 mm; for the angle formed by the side surface of groove, groove angle θ3 on the upstream side=45 to 90 degrees, and groove angle θ4 on the downstream side=90 to 150 degrees. Also, the peak width W1 on the mountain portion formed between grooves is preferably 0 to 50 mm, and more preferably, 2 to 50 mm making allowance for wear. Furthermore, the angles r1 and r2 formed between groove bottom and groove side surfaces are each preferably 0 to 10 mm, and the angles R1 and R2 formed between the peak and the groove side surfaces are each preferably 0 to 10 mm. Here, if the groove width W2 or groove depth D1 is lower than the lower limit value thereof, vortex flows easily occur, and the processing raw material becomes prone to pulverization. On the other hand, if the groove width W2, groove depth D1, peak width W1, or angles r1, r2, R1 or R2 exceeds the upper limit value thereof, or if the groove angles θ3 or θ4 comes out of a predetermined range, swirling flows become difficult to occur, so that the stay time in the grooves of the processing raw material is prone to be short.

(Supply Port and Discharge Port)

As shown in FIG. 1A, the supply port 6 is arranged at one end (lower end) of the main body portion 4, and used for supplying the processing raw material into the gap 5 formed between the rotor 2*a* and stator 3*a*, together with an airflow. The discharge port 7 is arranged at the other end (upper end) of the main body portion 4, and used for discharging, from the gap 5, a processed product that has been spheroidized and further compounded between the rotor 2*a* and stator 3*a*.

The powder processing apparatus according to the present embodiment is configured so that at least two kinds of processing raw materials are used and that a processed product obtained by compounding the at least two kinds of processing raw materials is discharged from the gap 5 to the discharge port 7.

According to this arrangement, contact between the wall surfaces and processing raw material and contact between particles of the processing raw material increase; the compounding of processing raw material advances; and the throughput of the apparatus is improved. Furthermore, heat generated by the compounding processing can be reduced by an airflow and the increase in processing temperature can be suppressed. Unlike the case of the gap formed by protrusion members provided in parallel with the axis line in the conventional powder processing apparatus, the occurrence of strong vortex flows in the gap can be reduced to thereby prevent the processing raw material from pulverization. Moreover, the processed product that has been subjected to compounding processing between the rotor 2*a* and stator 3*a* are discharged from the gap 5 into the discharge port 7 together with airflow.

In order to facilitate the supply of processing raw materials and the discharge of a processed product, it is preferable that both of the supply port 6 and discharge port 7 be arranged along the tangential direction of the rotor 2*a*. In FIG. 1A, the supply port 6 and discharge port 7 are disposed so as to form an angle of 180 degrees with each other, but the relative disposition therebetween is not limited. They may be disposed along the same direction (angle therebetween: 0 degree), or disposed along directions forming another angle (e.g., 90 degrees). Also, the arrangement may be such that the supply port 6 is arranged at the other end (upper end) and the discharge port 7 is arranged at the one end (lower end).

Next, a second embodiment of a powder processing apparatus will be described.

Figure 2C:
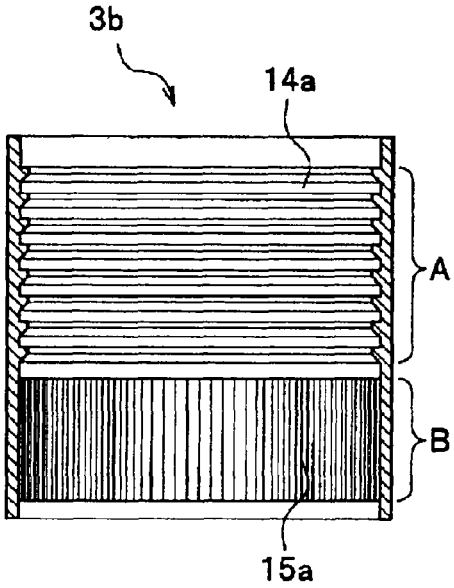
Figure 2D:
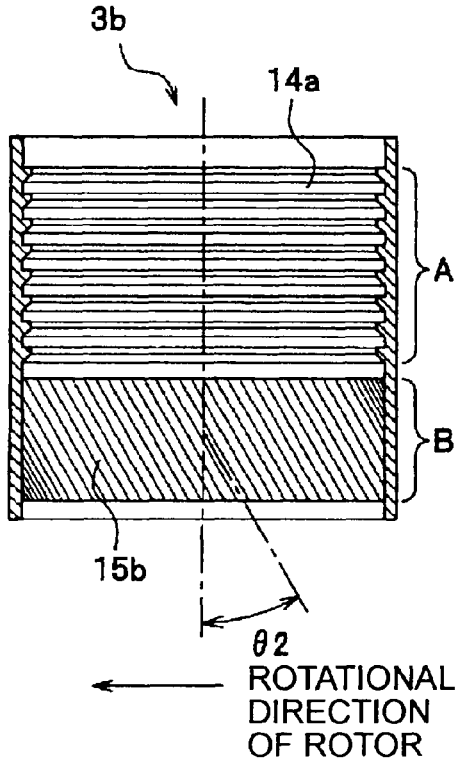

The powder processing apparatus (not shown) according to the second embodiment is one in which a stator 3*b* shown in FIGS. 2C and 2D is used instead of the stator 3*a* constituting the above-described powder processing apparatus according to the first embodiment. Other constructions are the same as those of the first embodiment, and therefore description thereof is omitted herein.

(Second Stator)

As in the case of the stator 3*a* (refer to FIGS. 2A and 2B), the stator 3*b* is a cylinder body made of a metal or the like. In the inner peripheral surface of the stator 3*b*, there are provided a first groove formation region A and second groove formation region B formed contiguously with the first groove formation region A. The first groove formation region A is a region that has functions of spheroidizing and further compounding the processing raw material. On the other hand, the second groove formation region B has a function of dispersing the processing raw material, or the processing raw material that has bee subjected to the spheroidization processing and further compounding processing. The second groove formation region B may be disposed at any one of the upper end side (side of the discharge port 7 in FIG. 1), intermediate portion, lower end (side of the supply port 6 in FIG. 1) of the stator 3*b*. A plurality of the first groove formation regions A and a plurality of the second groove formation regions B may also be provided. The ratio B/A of the length of the second groove formation region B with respect to the first groove formation region A is preferably ⅕ to ½, allowing for the spheroidization effect (compounding effect) and dispersion effect. Here, the "length" refers to the total length in each region. Furthermore, it is preferable that the inner peripheral surface of the stator 3*b* have been subjected to anti-wear processing.

(First Groove Formation Region)

The first groove formation region A is a region where, in the inner peripheral surface of the stator 3*b*, there are provided circumferential grooves 14*a* orthogonally intersecting the axis line of the stator 3*b*, or a spiral groove 14*b* forming an angle of not less than 60 degrees and less than 90 degrees with respect to the axis line. Because the circumferential grooves 14*a* and spiral groove 14*b* is the same as those in the first embodiment (the first stator 3*a*), description thereof is omitted herein.

(Second Groove Formation Region)

The second groove formation region B is a region where, in the inner peripheral surface of the stator, vertical grooves 15*a* parallel to the axis line of the stator 3*b*, or oblique vertical grooves 15*b* forming an angle θ2 of more than 0 degree and not more than 45 degrees with respect to the axis line are formed. When the angle θ2 of the oblique vertical grooves 15*b* is 0 degree, this oblique vertical grooves 15*b* is equivalent to the vertical groove 15*a*. When the θ2 exceeds 60 degrees, the dispersion effect of the oblique vertical grooves 15*b* on the processing raw material or processed product disappears. Here, the tilt of the oblique vertical grooves 15*b* from the lower end toward the upper end of the stator 3*b* may either be the frontward tilt or backward tilt with respect to the rotational direction of the rotor 2*a*. However, the tilt of the oblique vertical grooves 15*b* is preferably the backward tilt because the processing raw material is more easily supplied into the grooves, or processed product is more easily discharged under this condition.

The shapes of the vertical grooves 15*a* and oblique vertical grooves 15*b* are preferably rectangle (trapezoid) or U-shape (refer to concave portions 19*a* in FIG. 5A and concave portions 19*c* in FIG. 6B). The size of the groove configuration (not shown) is preferably as follows: groove depth=5 to 15 mm, the peak width on the mountain portion formed between grooves is 2 to 10 mm, and peak pitch=5 to 50 mm. Here, if the groove depth, peak width, or peak pitch is lower than the lower limit value thereof, pulverization action increases, while if they exceed the upper limit value thereof, the dispersion action becomes prone to decrease.

Next, a preferred embodiment of powder processing apparatus will be explained.

The preferable powder processing apparatus (not shown) in which a rotor 2*b* shown in FIGS. 4A and 4B is used instead of the rotor 2*a* constituting the above-described powder processing apparatuses according to the first and second embodiments. Other constructions are the same as those of the first and second embodiments, and therefore description thereof is omitted herein.

(Second Rotor)

The rotor 2*b* is a cylinder body made of a metal or the like as in the case of the rotor 2*a* (refer to FIG. 1). On the outer peripheral surface of the rotor 2*b*, there are provided vertical convex portions 16*a* parallel to the axis line of the rotor 2*b*, or oblique convex portions 16*b* forming an angle of more than 0 degree and not more than 45 degrees with the axis line.

With this arrangement, the vertical convex portions 16*a* or the oblique convex portions 16*b* formed on the outer peripheral surface of the rotor 2*b*, enhances the effect of swirling the processing raw material in the grooves of the rotor 2*b*, thereby even more promoting the spheroidization processing.

When the angle θ5 of the oblique convex portions 16*b* is 0 degree, this oblique convex portions 16*b* is equivalent to the vertical convex portions 16*a*. When the θ5 exceeds 45 degrees, the swirling flow improving effect of the oblique convex portions 16*b* decreases. Here, the tilt of the oblique convex portions 16*b* from the lower end toward the upper end of the rotor 2*b* may either be the frontward tilt or backward tilt with respect to the rotational direction of the rotor 2*b*. However, the tilt of the oblique convex portions 16*b* is preferably the backward tilt because the swirling flows are more easily improved under this condition.

The concave configurations formed between convex portions of vertical convex portions 16*a* or oblique convex portions 16*b* are preferably rectangle (trapezoid) [refer to concave portions 19*a* in FIG. 5A], triangle (refer to concave portions 19*b* in FIG. 6A), or U-shape (refer to concave portions 19*c* in FIG. 6B). The bottom surface of each concave portion is formed an arc or plane parallel to the outer peripheral surface of the rotor 2*b*. The rotor 2*b* may be one formed by embedding a blade 16*c* (refer to FIG. 6C) into the outer surface of the rotor, instead of vertical convex portions 16*a* or oblique convex portions 16*b*.

As shown in FIG. 5A, the size of the convex portions of the vertical convex portions 16*a* or oblique convex portions 16*b* is preferably as follows: the convex portion height D2=5 to 15 mm, convex portion peak width W3=0 to 10 mm, peak pitch P=5 to 10 mm, and angle r3 formed between convex portion bottom and convex portion side surfaces is 0<r3<2D2. Here, if the convex portion height D2 or peak pitch P is lower than the lower limit value thereof, vortex flows in the concave portion 19*a* become strong, and a force for pressing the processing raw material against the groove bottom portions of the stator decreases, so that the stay time of the processing raw material in the grooves is prone to be short. On the other hand, if the convex portion height D2, convex portion peak width W3, peak pitch P, or angle r3 exceeds the upper limit value thereof, swirling flows become less prone to occur, whereby the stay time of the processing raw material in the grooves is apt to be short. The peak pitch P is more preferably 20 to 60 mm.

As shown in FIG. 5B, the vertical convex portions 16*a* or oblique convex portions 16*b* may have a shape that tilts either frontward or backward with respect to the rotational direction. It is preferable that the tilt angle θ6 of the convex portion front side surface 17 be 45 degrees, and that the tilt angle θ7 of the convex portion back side surface 18 be −45 to 45 degrees. Here, the tilt angle θ6 is defined by an extension line of the convex portion front side surface 17, and a line connecting the rotational center of the rotor 2*b* and the front side corner of the convex peak surface. On the other hand, the tilt angle θ7 is defined by an extension line of the convex portion back side surface 18, and a line connecting the rotational center of the rotor 2*b* and the back side corner of the convex peak surface.

Another preferable embodiment of powder processing apparatus (not shown) in which a rotor 2*c* shown in FIGS. 4C and 4D is used instead of the rotor 2*a* constituting the above-described powder processing apparatuses according to the first and second embodiments. Other constructions are the same as those of the first and second embodiments, and therefore description thereof is omitted herein.

(Third Rotor)

The rotor 2*c* is a cylinder body made of a metal or the like as in the case of the rotor 2*a* (refer to FIG. 1). On the outer peripheral surface of the rotor 2*c*, there is provided a convex portion formation region C and a cylinder region D that is formed contiguously with the convex portion formation region C. Convex portion formation regions C and cylinder regions D may be provided at a plural of locations on the outer peripheral surface of the rotor 2*c*. The outer peripheral surface of the rotor 2*c* has preferably been subjected to anti-wear processing. The rotor 2*c* may be either a rotor in which both of the convex portion formation region C and cylinder region D are formed on the outer peripheral surface of one cylinder body by machining, or a rotor formed by integrally coupling a cylinder body having the convex portion formation region C on the outer peripheral surface and a cylinder body having the cylinder region D on the outer peripheral surface.

The convex portion formation region C is a region having the function of subjecting the processing raw material to the spheroidization processing and further compounding processing. The cylinder region D is a region having the function of moving the processing raw material that is moving in the concave portions formed between the vertical convex portions 16*a* or between oblique convex portions 16*b* (not shown), to the groove bottoms of the circumferential grooves 14*a* or spiral groove 14*b* of the stators 3*a* and 3*b* shown in FIGS. 2A to 2D and that subjects it to the spheroidization processing and further compounding processing. The length of each cylinder region D is preferably not more than 50 mm. The total length of the cylinder region D is preferable not more than 20% of that of the convex portion formation region C. If the length of each cylinder region D exceeds 50 mm, or the total length of the cylinder region D exceeds 20% of that of the convex portion formation region C, the area of convex portion formation region C, which is closely related to the spheroidization processing and compounding processing, becomes small. This makes it difficult for the processing raw material to be subjected to the spheroidization processing and compounding processing.

(Convex Portion Formation Region)

The convex portion formation region C is a region where, on the outer peripheral surface of the rotor 2*c*, there are provided vertical convex portions 16*a* parallel to the axis line of the rotor 2*c*, or oblique convex portions 16*b* (not shown) forming an angle more than 0 degree and not more than 45 degrees with respect to the axis line. Because the vertical convex portions 16*a* and oblique convex portions 16*b* is the same as those in the second rotor 2*b*, description thereof is omitted herein.

(Cylinder Region)

The cylinder region D is a region that is smoothly formed contiguously with the above-described convex portion formation region C, and that has an outer diameter larger than the minimum outer diameter in the convex portion formation region C, and of not more than the maximum outer diameter therein.

According to this arrangement, even in the event that the processing raw material moves through the concave portion formed between the vertical convex portions 16*a* or between oblique convex portions 16*b* without the processing raw material being pressed against the groove bottoms, the provision of the cylinder region D allows the processing raw material that is moving in the concave portions to move to the groove bottoms of the stator, and enables the processing raw material to be subjected to the spheroidization processing. This even more promotes the spheroidization processing of processing raw material.

Here, if the outer diameter of the cylinder region D is smaller than the minimum outer diameter of the convex portion formation region C (i.e., the outer diameter measured at the bottom portion of the concave portion 19*a* in FIG. 5A), then, the effect of moving the processing raw material in the concave portion 19*a* to the stator 3*a* or 3*b* disappears. On the other hand, if the outer diameter of the cylinder region D exceeds the maximum outer diameter of the convex portion formation region C (i.e., the outer diameter measured at a position of the peak surface of the vertical convex portions 16*a* or the oblique convex portions 16*b* in FIG. 5A), then, the movement of the processing raw material in the concave portion 19*a* to the stator 3*a* or 3*b*.

[Powder Processing System]

Next, powder processing system will be described. First, a first embodiment of powder processing system (for spheroidization processing) used for the spheroidization processing of powder is explained.

Figure 7:
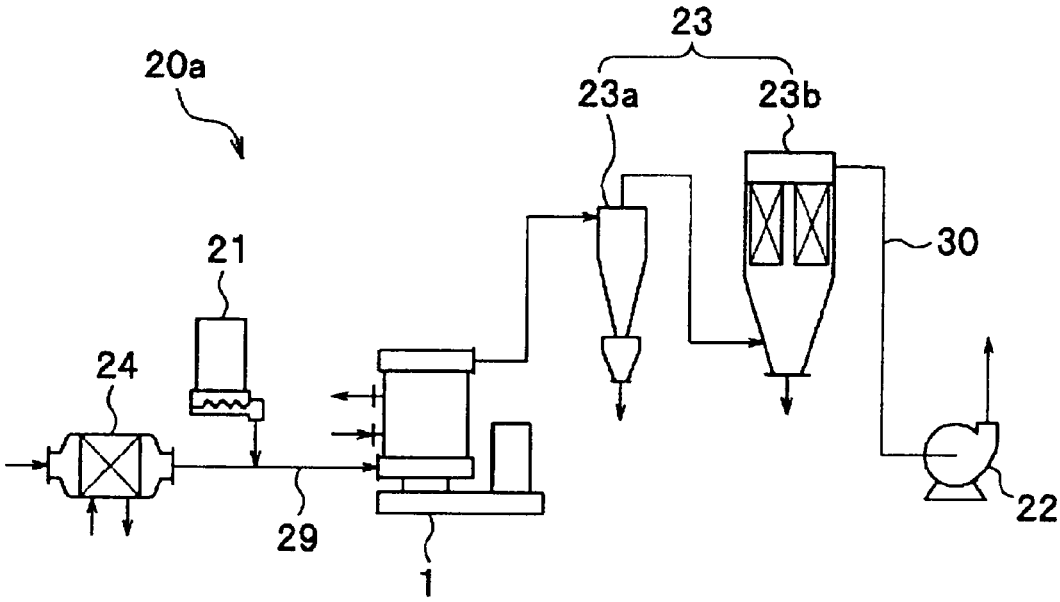
FIG. 7 is a schematic diagram showing the construction of a powder processing system (spheroidization processing) according to the present invention.

As shown in FIG. 7, the powder processing system (for spheroidization processing) 20*a* uses the powder processing apparatus 1 illustrated in FIG. 1 to FIG. 6C. The powder processing system (for spheroidization processing) 20*a* includes: a raw material supply device 21 that is arranged upstream of the powder processing apparatus 1, and that supplies a processing raw material to the powder processing apparatus 1 (supply port 6 in FIG. 1) together with the airflow, via a supply duct 29; an exhaust device 22 arranged downstream of the powder processing apparatus, the exhaust device generating an airflow that is supplied to the powder processing apparatus 1 (supply port 6) by the suction of air via the discharge duct 30 and that is discharged from the powder processing apparatus 1 (discharge port 7); a recovery device 23 that is arranged upstream of the exhaust device 22, and that recovers a processed product that has been spheroidized by the powder processing apparatus 1, from the airflow discharged from the powder processing apparatus 1 (discharged port 7); and a cooler 24 that is arranged upstream of the powder processing apparatus 1, and that cools the airflow to be supplied to the powder processing apparatus 1 (supply port 6).

As the raw material supply device 21, a conventional known supply device, such as a screw type or table type is used. However, the raw material supply device 21 is not limited to the supply devices described above but may include other known types that perform the required functions. As the recovery device 23, a conventional known recovery device, such as a cyclone 23*a*, bag filter 23 or the like is used. In FIG. 7, the cyclone 23*a* and bag filter 23*b* are used in combination, but the bag filter 23*b* alone may be used.

As the cooler 24, preferably, a conventional known cooler is used, and performs functions as cooling and dehumidifying air flows. The cooling temperature is set as appropriate depending on processing raw material. For example, in the case of toner, an airflow is cooled to 0 to 5° C. In FIG. 7, the cooler 24 is provided upstream of the raw material supply device 21, but it may be provided downstream of the raw material supply device 21. By providing the powder processing system (for spheroidization processing) 20*a* with the cooler 24, the spheroidization of the processing raw material is promoted. As a result, the spheroidization processing throughput of the system is enhanced. This is especially prominent when processing raw materials are low-melting materials, or supply amounts of the processing raw materials are large.

Figure 8:
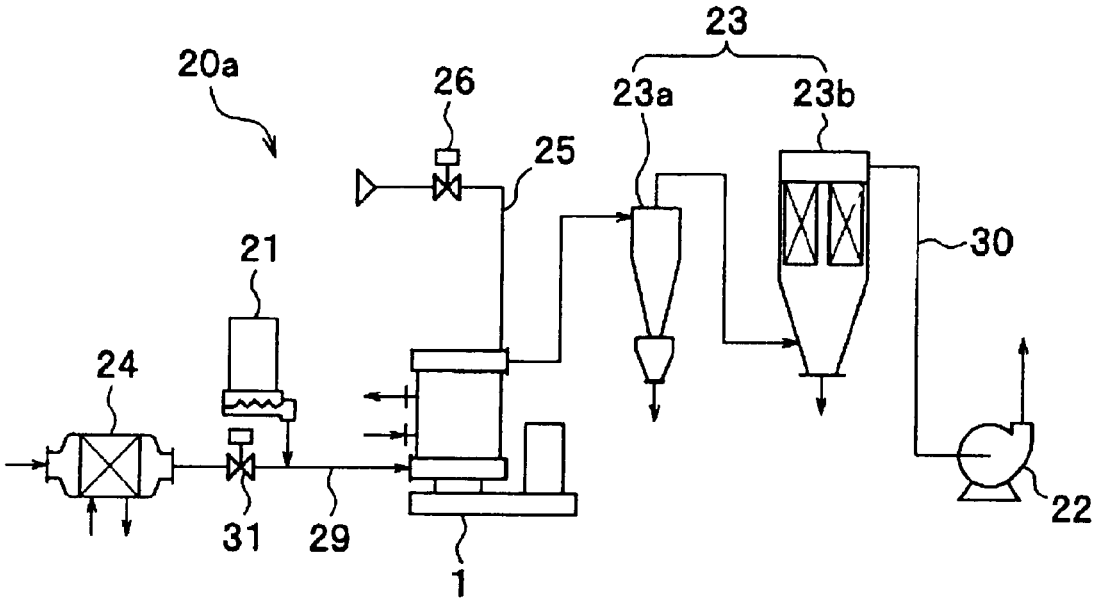
FIG. 8 is a schematic diagram showing the construction of another powder processing system (spheroidization processing) according to the present invention.

It is preferable that, as shown in FIG. 8, the powder processing system (for spheroidization processing) 20*a* have a gas introduction duct 25 branched off from the powder processing apparatus 1 (discharge port 7), and that the gas introduction duct 25 have a continuous open/close damper 26.

The gas introduced into the gas introduction duct 25 is outside air, but an inactive gas such as nitrogen may be used. As the continuous open/close damper 26, a conventional known damper, such as a rotary type, butterfly type, or gate type, is used. The use of the continuous open/close damper 26 adjusts the flow rate (flow amount) of airflow in the powder processing apparatus 1, and allows the stay time of the processing raw material in the powder processing apparatus 1 to be prolonged, leading to an increase in the spheroidization processing throughput.

More specifically, when the continuous open/close damper 26 has been closed, an airflow flowing in the powder processing apparatus 1 speeds up, and when it is open, the airflow slows down. By continuously opening/closing the continuous open/close damper 26, an airflow in the powder processing apparatus 1 pulsates. When the airflow speeds up, the processing raw material moves in the powder processing apparatus 1 from the supply port 6 into the discharge port 7. On the other hand, when the airflow slows down, the processing raw material stays in the circumferential grooves or spiral grooves of the stator 3*a* or 3*b*. Therefore, an adjustment of the open/close timing of the continuous open/close damper 26 allows the prolongation of the stay time of the raw material, thereby advancing the spheroidization processing and enhancing the throughput of the system. Because the processed product that has been subjected to spheroidization processing is discharged from the discharge port 7 by a fast airflow with a constant speed, there is no occurrence of adhesion of the processed product to the inside of the discharge port 7.

Also, by the fast airflow with a constant speed, the processed product is discharged from the powder processing apparatus 1 (discharge port 7). As a consequence, adhesion of the processed product to the inside of the discharge port 7, and a detrimental effect on the recovery device 23 disposed downstream of the powder processing apparatus 1 be easily prevented. The arrangement may be such that a fixed damper 31 is provided upstream of the raw material supply device 21, and that a flow amount balance between the outside and the powder processing apparatus 1 side is adjusted.

Figure 9:
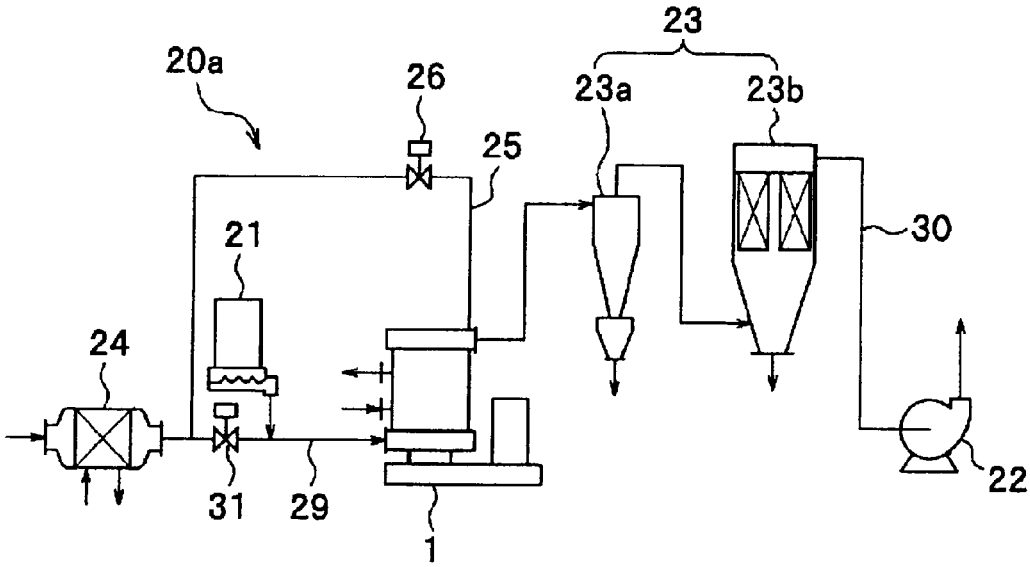
FIG. 9 is a schematic diagram showing the construction of still another powder processing system (spheroidization processing) according to the present invention.

As shown in FIG. 9, the upstream side of the continuous open/close damper 26 is preferably connected between the cooler 24 and raw material supply device 21. According to this arrangement, the cooler 24 is provided upstream of the continuous open/close damper 26, whereby a cooled airflow is supplied into the discharge port 7 via the gas introduction duct 25. This enables a processed product that has been spheroidized, to be cooled, thereby preventing the adhesion of the processed product to the inside of the powder processing apparatus 1 (discharge port 7).

Next, a second embodiment of the powder processing system will be described.

Figure 10:
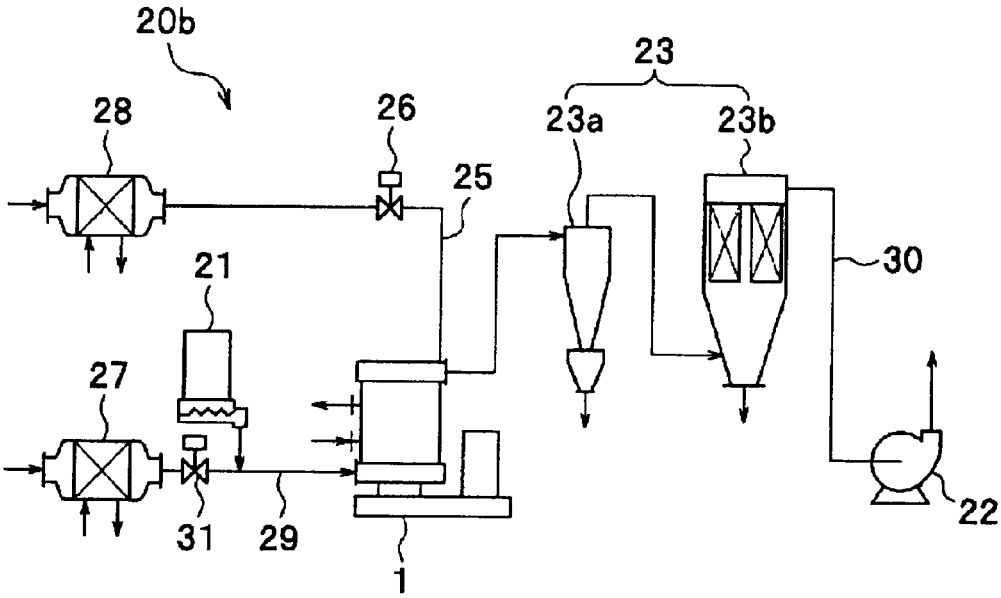
FIG. 10 is a schematic diagram showing the construction of a further powder processing system (spheroidization processing) according to the present invention.

As shown in FIG. 10, the powder processing system (for spheroidization processing) 20*b* has a heater 27 instead of the cooler 24 in the powder processing system (for spheroidization processing) 20*a* (refer to FIG. 8). Other constructions are the same as those of the first and second embodiments, and therefore description thereof is omitted herein.

As the heater 27, a conventional known heater or the like is used. The heating temperature is set as appropriate depending on processing raw material. In FIG. 10, the heater 27 is provided upstream of the raw material supply device 21, but it may be provided downstream of the raw material supply device 21. By providing the powder processing system (for spheroidization processing) 20*b* with the heater 27, the spheroidization of the processing raw materials is promoted. As a result, the spheroidization processing throughput of the system is enhanced. This is especially prominent when processing raw materials are high-melting material, which is resistant to heat, and the spheroidization processing advances at a high temperature.

As in the case of the powder processing system (for spheroidization processing) 20*a*, it is preferable that the powder processing system (for spheroidization processing) 20*b* have the gas introduction duct 25 and that the gas introduction duct 25 has a continuous open/close damper 26.

According to this arrangement, as in the case of the above-described powder processing apparatus, the continuous open/close damper 26 is provided, and by adjusting its open/close timing, the stay time of the raw material can be prolonged, thereby the spheroidization processing advances and the throughput of the system increases. Because the processed product that has been subjected to spheroidization processing is discharged from the discharge port 7 by a fast airflow with a constant speed, there is no occurrence of adhesion of the processed product to the inside of the discharge port 7.

It is preferable that a cooler 28 be provided upstream of the continuous open/close damper 26. By providing the cooler 28, a cooled airflow is supplied into the discharge port 7 via the gas introduction duct 25. This enables a processed product that has been spheroidized by heating, to be cooled, thereby preventing the adhesion of the processed product to the inside of the powder processing apparatus 1 (discharge port 7).

Depending on the characteristic of a processing raw material, the powder processing systems (for spheroidization processing) 20*a* and 20*b* do not necessarily require the cooler 24 and 28, respectively, and the powder processing system (for spheroidization processing) 20*b* does not necessarily require the heater 27.

Figure 11:
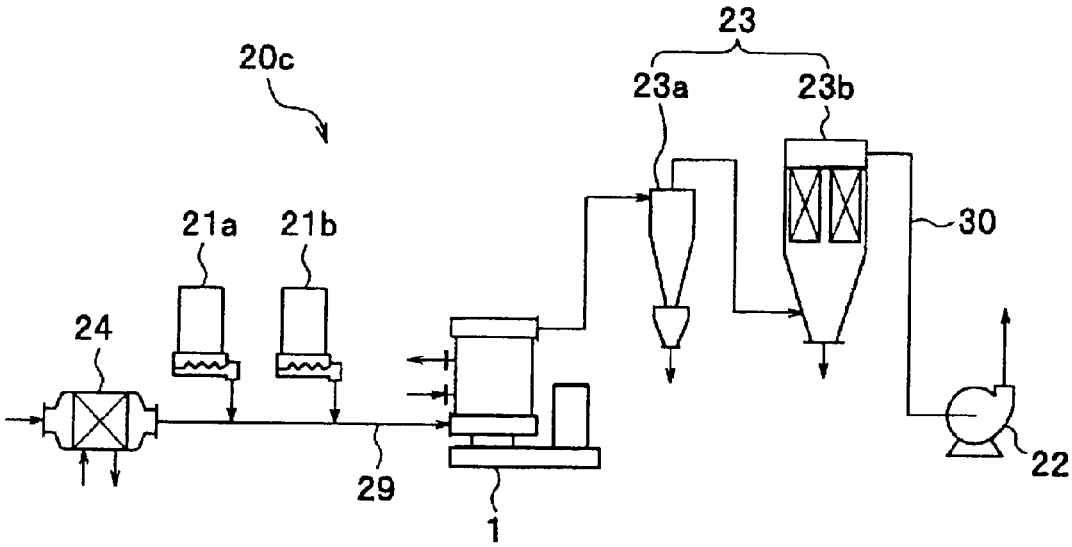
FIG. 11 is a schematic diagram showing the construction of a powder processing system (compounding processing) according to the present invention.

Next, a first embodiment of a powder processing system (for compounding processing) that is used for the compounding processing of powder is shown in FIG. 11. As shown in FIG. 11, the powder processing system (for compounding processing) 20*c* uses the powder processing apparatus 1 illustrated in FIG. 1 to FIG. 6C. The powder processing system (for spheroidization processing) 20*a* has the same construction as that of the powder processing system (for spheroidization processing) 20*a*, with the exception that, as the raw material supply device 21 (refer to FIG. 7), the powder processing system (for compounding processing) 20*c* uses a first raw material supply device 21*a* and second raw material supply device 21*b* for individually supplying two kinds of processing raw material. With this arrangement, the present invention allows a promotion of the compounding of the processing raw materials, leading to an increase in compounding processing throughput of the system. This is especially prominent when the processing raw materials are low-melting materials, or supply amounts of the processing raw materials are large.

The first raw material supply device 21*a* and second raw material supply device 21*b* use the same device as the raw material supply device 21 in the powder processing system (for spheroidization processing) 20*a*. Other constructions are same as those of the powder processing system (for spheroidization processing) 20*a*, and therefore description thereof is omitted herein.

Here, in order to address at least two kinds of processing raw material, the raw material supply device is increased in the number in accordance with the number of kinds of processing raw materials.

That is, the first embodiment of a powder processing system (for compounding processing) 20*c* is configured so that a plurality of raw material supply devices that use at least two kinds of processing raw materials and that supply the at least two kinds of processing raw materials are provided upstream of the powder processing apparatus 1, and a processed product that have been compounded by the powder processing apparatus 1 is recovered.

According to this arrangement, the at least two kinds of processing raw materials that has been individually supplied from a plurality of raw material supply devices to an airflow which has been temperature-adjusted, and which has been supplied into the powder processing apparatus 1 together with the temperature-adjusted airflow are mixed in the gap on the side of the supply port 6 of the powder processing apparatus 1, and a processing raw material, serving as additional powder (powder with a smaller diameter) adheres to the surface of a processing raw material, serving as base powder (powder with a smaller diameter). As the processing raw materials approach the gap on the side of the discharge port 7, the two processing raw materials are compounded.

Figure 12:
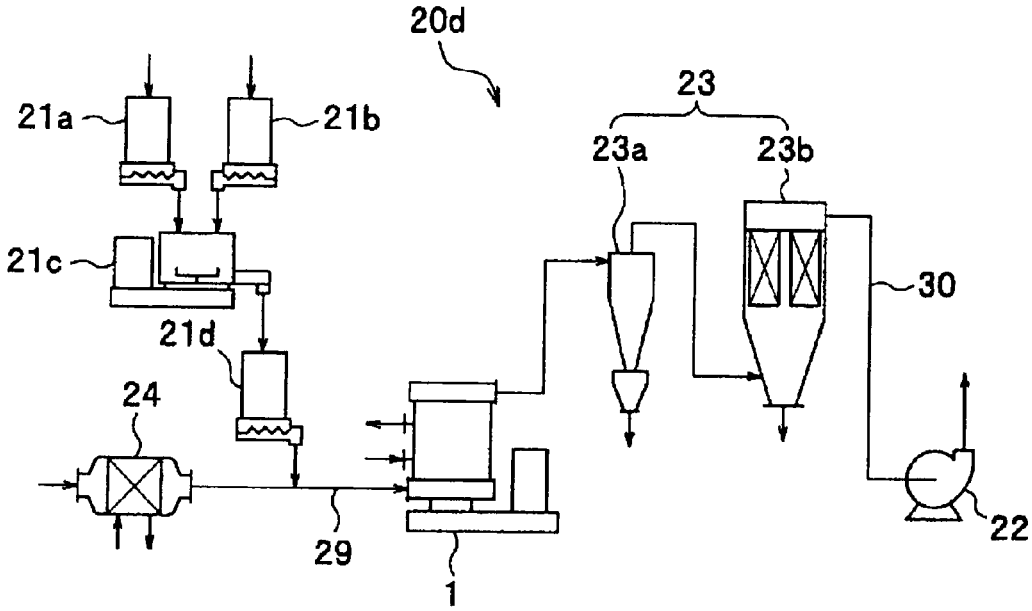
FIG. 12 is a schematic diagram showing the construction of another powder processing system (compounding processing) according to the present invention.

Next, a second embodiment of a powder processing system (for compounding processing) is shown in FIG. 12.

As shown in FIG. 12, the powder processing system (for compounding processing) 20*d* has a raw material mixer 21 on the downstream side of the first raw material supply device 21*a* and second raw material supply device 21*b* of the powder processing system (for compounding processing) 20*c* refer to FIG. 11). In the present system, after two kinds of processing raw materials have been mixed in advance, the mixed processing raw materials are supplied to the powder processing apparatus 1. In order to adjust supply amount of the mixed processing raw materials, a third raw material supply device 21*d* may be provided downstream of the raw material mixer. With this arrangement, the present invention allows a promotion of the compounding of the processing raw materials, thereby even more improving the compounding processing throughput of the system.

The first to third raw material supply device 21*a*, 21*b*, and 21*c* use the same device as the raw material supply device 21 in the powder processing system (for spheroidization processing) 20*a*, and the raw material mixer uses a conventional known mixer. Other constructions are same as those of the powder processing system (for compounding processing) 20*c*, and therefore description thereof is omitted herein.

Here, the powder processing system 20*d* includes: the above-described powder processing apparatus 1; an exhaust device 22 arranged downstream of the powder processing apparatus 1 and generating an airflow that is supplied into the supply port 6 and that is discharged from the discharge port 7; a plurality of raw material supply devices 21*a*, 21*b*, and 21*d* that are arranged upstream of the powder processing apparatus 1, and that supply a plurality of raw materials to the airflow formed upstream of the powder processing apparatus, in order to supply the at least two kinds of processing raw materials into the supply port 6, together with the airflow formed upstream of the powder processing apparatus 1; and a recovery device that is arranged upstream of the exhaust device 22, and that recovers a processed product compounded by the powder processing apparatus 1 from the airflow that has been discharged from the discharged port 7.

According to this arrangement, the at least two kinds of processing raw materials that has been individually supplied from a plurality of raw material supply devices into the powder processing apparatus 1 are mixed in the gap on the side of the supply port 6 of the powder processing apparatus 1, and a processing raw material, serving as additional powder (powder with a smaller diameter) adheres to the surface of a processing raw material, serving as base powder (powder with a smaller diameter). As the processing raw materials approach the gap on the side of the discharge port 7, the two processing raw materials are compounded.

While not shown, it is preferable that the powder processing systems (for compounding processing) 20*c* and 20*d* have a gas introduction duct 25 and continuous open/close damper 26 branched off from the powder processing apparatus 1 (refer to FIG. 8). Also, the upstream side of the continuous open/close damper 26 is preferably connected between the cooler 24 and the first raw material supply device 21*a* or third raw material supply device 21*d*. With this arrangement, the present invention allows an increase in the compounding processing throughput with respect to the processing raw materials, as well as prevents adhesion of the processed product to the inside of the discharge port 7, and a detrimental effect on the recovery device 23 disposed downstream of the powder processing apparatus 1. Although the cooler 24 is disposed upstream of the first raw material supply device 21*a* or the third material supply device 21, it may be disposed downstream of them.

While not shown, the powder processing systems (for compounding processing) 20*c* and 20*d* may have each a heater 27 (refer to FIG. 10) instead of the above-described cooler 24. With this arrangement, the present invention enables a promotion of the compounding processing with respect to the processing raw material, thereby enhancing the throughput of the system. This is especially prominent when processing raw materials are high-melting material, which is resistant to heat, and the compounding processing advances at a high temperature. Here, the powder processing system (for compounding processing) with the heater 27 also has preferably the gas introduction duct 25 and continuous open/close damper 26 (refer to FIG. 10), and more preferably, has a cooler 28 (refer to FIG. 10) upstream of the continuous open/close damper 26. This prevents adhesion of the processed product to the inside of the powder processing apparatus 1. Here, the heater 27 may be disposed either on the upstream side or downstream side of the first raw material supply device 21*a* or third raw material supply device 21*d*.

Depending on the characteristic of a processing raw material, the powder processing systems (for compounding processing) 20*c* and 20*d* do not necessarily require the cooler 24 and a heater (not shown).

Next, a method for spheroidization processing in the powder processing apparatus and powder processing system (for spheroidization processing) will be described with reference to FIGS. 1A, 1B, and 7.

(1) By driving the exhaust device 22 in the powder processing system (for spheroidization processing) 20*a*, an airflow is generated in the supply duct 29, powder processing apparatus 1, and discharge duct 30.

(2) By rapidly rotating the rotor 2*a* of the powder processing apparatus 1 under the drive by a drive unit (not shown), swirling flows are generated in the gap 5 formed outside the rotor 2*a*, i.e., in the circumferential grooves 14*a* formed in the inner peripheral surface.

(3) By driving the raw material supply device 21 in the powder processing system (for spheroidization processing) 20*a*, a processing raw material is supplied into the supply duct 29. The processing raw material that has been dispersed in the airflow is supplied into the supply port 6 of the powder processing apparatus 1 by the airflow in the supply duct 29.

(4) The processing raw material that has been supplied from the supply port 6 together with the airflow moves from the lower end of the stator 3*a* to its upper end while being pressed against the circumferential grooves 14*a* by the swirling flows generated in the circumferential grooves 14*a* of the stator 3*a*. At this time, the processing raw material makes strong contact with the wall surfaces of the circumferential grooves 14*a*, or particles of the processing raw material make strong contact with one another, so that the processing raw material is spheroidized. The processed product that has been spheroidized is discharged from the gap 5 into the discharge port 7.

(5) The processed product that has been discharged into the discharge port 7, is successively discharged to the cyclone

23*a* and bag filter 23*b* serving as the recovery device 23 by the airflow in the discharge duct 30. Here, the processed product that has been spheroidized is recovered by the cyclone 23*a* and bag filter 23*b*.

Next, a method for compounding processing in the powder processing apparatus and powder processing system (for compounding processing) will be described with reference to FIGS. 1A, 1B, 11, and 12.

(1) By driving the exhaust device 22 in the powder processing system (for compounding processing) 20*c*, an airflow is generated in the supply duct 29, powder processing apparatus 1, and discharge duct 30.

(2) By rapidly rotating the rotor 2*a* of the powder processing apparatus 1 under the drive by a drive unit (not shown), swirling flows are generated in the gap 5 formed outside the rotor 2*a*, i.e., in the circumferential grooves 14*a* formed in the inner peripheral surface.

(3) By driving the first raw material supply device 21*a* and second raw material supply device 21*b* in the powder processing system (for compounding processing) 20*c*, the first raw material (base powder) to be processed and second raw material (additional powder) to be processed are individually supplied into the supply duct 29. The first and second processing raw materials that have been dispersed in the airflow is supplied into the supply port 6 of the powder processing apparatus 1 by the airflow in the supply duct 29.

(4) The first and second processing raw material that have been supplied from the supply port 6 together with the airflow moves from the lower end of the stator 3*a* to its upper end while being pressed against the circumferential grooves 14*a* by the swirling flows generated in the circumferential grooves 14*a* of the stator 3*a*. At this time, the first and second processing raw materials make strong contact with the wall surfaces of the circumferential grooves 14*a*, or particles of the processing raw material make strong contact with one another, so that the second raw material (additional powder) adheres to the surface of the first raw material (base powder) to be processed, leading to compounding. The processed product that has been compounded is discharged from the gap 5 into the discharge port 7.

(5) The processed product that has been discharged into the discharge port 7, is successively discharged to the cyclone 23*a* and bag filter 23*b* serving as the recovery device 23 by the airflow in the discharge duct 30. Here, the processed product that has been compounded is recovered by the cyclone 23*a* and bag filter 23*b*.

In the powder processing system (for compounding processing) 20*d*, the procedure of the above-described item (3) is as follows.

By driving the first raw material supply device 21*a* and second raw material supply device 21*b*, the first raw material (base powder) to be processed and the second processing raw material are supplied to the raw material mixer. By driving the raw material mixer, the first raw material (base powder) to be processed and the second processing raw material are uniformly mixed, and mixed processing raw materials in which the second raw material (additional powder) has been adhered to the surface of the first raw material (base powder) to be processed, is generated. The mixed processing raw materials are supplied into the supply duct 29 under the drive by the third raw material supply device 21*d*, and supplied into the supply port 6 of the powder processing apparatus 1 by the airflow in the supply duct 29. As the procedure of the above-described item (4), the mixed processing raw materials in which the second raw material (additional powder) has been adhered to the surface of the first raw material (base powder) to be processed, are compounded. Here, the mixed processing raw materials may be supplied form the raw material mixer into the supply duct 29 without using the third raw material supply device 21*d*. Other procedures are the same as those in the powder processing system (for compounding processing) 20*c*, and therefore its description is omitted herein.

In the powder processing systems (for compounding processing) 20*c* and 20*d*, the processing raw materials are supplied from the plurality of raw material supply device 21*a*, 21*b*, and 21*c*. However, the way of supplying the processing raw materials may also be such that a plurality of processing raw materials are sufficiently mixed in advance outside the system, and that the processing raw materials that has been mixed in advance are supplied from one raw material supply device (not shown).

While there has been described the powder processing apparatus 1 of the first embodiment, the powder processing system (for spheroidization processing) 20*a*, and the powder processing systems (for compounding processing) 20*c* and 20*d*, methods for spheroidization processing and compounding processing in other embodiments are the same as those in the above-described embodiments, and therefore descriptions thereof are omitted.

Although the invention has been described with reference to the preferred embodiments in the attached figures, it is noted that equivalents may be employed and substitutions made herein without departing from the scope of the invention as recited in the Claims.

What is claimed is:

1. A powder processing apparatus comprising:

a main body portion including:

a cylindrical rotor that rotates at a high speed; and a cylindrical stator arranged coaxially to a rotational axis of the rotor, outside the rotor with a gap therebetween, wherein the powder processing apparatus further comprises:

a supply port that is provided at one end of the main body portion, and that supplies a processing raw material into the gap together with an airflow; and a discharge port that is provided at the other end of the main body portion, and that discharges, from the gap, a processed product obtained by spheroidizing the processing raw material between the rotor and the stator; and wherein, in the inner peripheral surface of the stator, there are provided circumferentially elongated grooves whose circumferential length direction orthogonally intersects the axis line of the stator, wherein, on the outer peripheral surface of the rotor, there are provided vertical convex portions parallel to the axis line of the rotor.

2. The powder processing apparatus according to claim 1, wherein, on the outer peripheral surface of the rotor, there is further provided a cylinder region that is smoothly formed contiguously with the vertical convex portions, and that has an outer diameter larger than the minimum outer diameter of the vertical convex portions, and of not more than the maximum outer diameter therein.

3. The powder processing apparatus according to claim 1, wherein, at least two kinds of processing raw materials are each used as the processing raw material; and wherein a processed product obtained by compounding the at least two kinds of processing raw materials between the rotor and the stator are discharged from the gap into the discharge port.

4. A powder processing system comprising the powder processing apparatus as recited in claim 3, the powder processing system further comprising:

an exhaust device arranged downstream of the powder processing apparatus, the exhaust device generating an airflow that is supplied into the supply port and that is discharged from the discharge port;

a plurality of raw material supply devices that are arranged upstream of the powder processing apparatus, and that supply at least two kinds of processing raw materials to an airflow formed upstream of the powder processing apparatus, in order to supply the at least two kinds of processing raw materials into the supply port together with the airflow formed upstream of the powder processing apparatus; and a recovery device that is arranged upstream of the exhaust device, and that recovers a processed product compounded by the powder processing apparatus, from the airflow that has been discharged from the discharged port.

5. The powder processing system according to claim 4, further comprising:

a raw material mixer that is provided downstream of the raw material supply devices, and that mixes the at least two kinds of processing raw materials.

6. A powder processing system comprising the powder processing apparatus as recited in claim 1, the powder processing system further comprising:

an exhaust device arranged downstream of the powder processing apparatus, the exhaust device generating an airflow that is supplied into the supply port and that is discharged from the discharge port;

a raw material supply device that is arranged upstream of the powder processing apparatus, and that supplies a processing raw material to the airflow formed upstream of the powder processing apparatus, in order to supply the processing raw material into the supply port together with the airflow formed upstream of the powder processing apparatus;

a recovery device that is arranged upstream of the exhaust device, and that recovers a processed product that has been spheroidized by the powder processing apparatus, from the airflow that has been discharged from the discharged port; and a cooler that is arranged upstream of the powder processing apparatus, and that cools the airflow to be supplied into the supply port.

7. The powder processing system according to claim 6, further comprising:

a gas introduction duct branched off from the discharge port; and a continuous open/close damper provided in the gas introduction duct.

8. The powder processing system according to claim 7, wherein the upstream side of the continuous open/close damper is connected between the cooler and the raw material supply device.

9. The powder processing system according to claim 6, wherein at least two kinds of processing raw materials are each used as the processing raw material;

wherein a plurality of raw material supply devices that supply the at least two kinds of processing raw materials are arranged upstream of the powder processing apparatus; and wherein a processed product that has been compounded by the powder processing apparatus is recovered by the recovery device.

10. The powder processing system according to claim 6, wherein a processing raw material that is made up by previously mixing at least two kinds of processing raw materials, is used as the processing raw material;

wherein one material supply device that supplies the processing raw material that has been obtained by the previous mixing is arranged upstream of the powder processing apparatus; and wherein a processed product that has been compounded by the powder processing apparatus is recovered by the recovery device.

11. A powder processing system comprising the powder processing apparatus as recited in claim 3, the powder processing system further comprising:

an exhaust device arranged downstream of the powder processing apparatus, the exhaust device generating an airflow that is supplied into the supply port and that is discharged from the discharge port;

one raw material supply device that is arranged upstream of the powder processing apparatus, and that supplies at least two kinds of processing raw materials mixed in advance to the airflow formed upstream of the powder processing apparatus, in order to supply the at least two kinds of processing raw materials into the supply port together with the airflow formed upstream of the powder processing apparatus; and a recovery device that is arranged upstream of the exhaust device, and that recovers a processed product compounded by the powder processing apparatus, from the airflow that has been discharged from the discharged port.

12. A powder processing system comprising the powder processing apparatus as recited in claim 1, the powder processing system further comprising:

a raw material supply device that is arranged upstream of the powder processing apparatus, and that supplies a processing raw material into the supply port together with the airflow;

an exhaust device arranged downstream of the powder processing apparatus, the exhaust device generating an airflow that is supplied into the supply port and that is discharged from the discharge port;

a recovery device that is arranged upstream of the exhaust device, and that recovers a processed product that has been spheroidized by the powder processing apparatus, from the airflow that has been discharged from the discharged port; and a heater that is arranged upstream of the powder processing apparatus, and that heats the airflow to be supplied into the supply port.

13. The powder processing system according to claim 12, further comprising:

a gas introduction duct branched off from the discharge port; and a continuous open/close damper provided in the gas introduction duct.

14. The powder processing system according to claim 13, further comprising:

a cooler provided upstream of the continuous open/close damper.

15. The powder processing apparatus according to claim 1, wherein said circumferentially elongated grooves are provided at a first groove formation region of the inner peripheral surface of the stator, further comprising a second groove formation region which is formed at the inner peripheral surface of the stator contiguously with the first groove formation region, and in which vertical grooves parallel to the axis line, or oblique vertical grooves forming an angle of more than 0 degree and not more than 45 degrees with respect to the axis line are formed.

16. The powder processing apparatus according to claim 1, wherein the circumferentially elongated grooves provided at the inner peripheral surface of the stator are continuous about the entire circumference of the stator.

17. The powder processing apparatus according to claim 1, wherein the axis line of the rotor extends generally vertically.

* * * * *